US006155808A

United States Patent [19]

White

[11] Patent Number: 6,155,808

[45] Date of Patent: Dec. 5, 2000

[54] HYDRAULIC MOTOR PLATES

[75] Inventor: Hollis Newcomb White, Hopkinsville, Ky.

[73] Assignee: White Hydraulics, Inc., Hopkinsville, Ky.

[21] Appl. No.: 09/062,319

[22] Filed: Apr. 20, 1998

[51] Int. Cl.[7] ..... F01C 1/10; F01C 19/00

[52] U.S. Cl. ..... 418/61.3; 418/149; 418/178; 418/179

[58] Field of Search ..... 418/61.3, 133, 418/178, 179, 149; 277/609, 611, 641, 642

[56] References Cited

U.S. PATENT DOCUMENTS

| | | | |
|---|---|---|---|
| 3,601,513 | 8/1971 | White, Jr. | 418/179 |
| 3,671,046 | 6/1972 | Hagmann | 277/641 |
| 3,826,596 | 7/1974 | Hansen et al. | 418/61.3 |
| 4,501,536 | 2/1985 | Middlekauff | 418/61.3 |
| 4,514,152 | 4/1985 | Takamatsu et al. | 418/61.3 |
| 4,569,644 | 2/1986 | Swedberg | 418/61.3 |
| 4,712,585 | 12/1987 | Evans | 277/609 |
| 4,976,594 | 12/1990 | Bernstrom | 418/61.3 |
| 5,492,336 | 2/1996 | Barna et al. | 277/609 |
| 5,593,296 | 1/1997 | Bernstrom et al. | 418/61.3 |

*Primary Examiner*—John J. Vrablik
*Attorney, Agent, or Firm*—Lightbody & Lucas

[57] ABSTRACT

A gerotor hydraulic pressure device using a powder metal wear plate to close off at least one end of a stator/rotor mechanism, with the wear plate having an axial length 0.003" greater than the cavity in the housing that contains it.

35 Claims, 9 Drawing Sheets

HYDRAULIC MOTOR PLATES

BACKGROUND OF THE INVENTION

Hydraulic pressure devices are efficient at producing high torque from relatively compact devices. Their ability to provide low speed and high torque make them adaptable for numerous applications. White U.S. Pat. Nos. 4,285,643, 4,357,133, 4,697,997 and 5,173,043 are examples of hydraulic motors.

DESCRIPTION OF PRIOR ART

Rotating valve hydraulic motors are well known in the art. Examples include the McDermott U.S. Pat. No. 3,572,983, the Vengers U.S. Pat. No. 3,749,195, the Thorson U.S. Pat. No. 4,343,600 and the Uppa, etal U.S. Pat. No. 4,762,479. The motors themselves, while serviceable, have complicated housing parts, necessitating numerous machining, drilling and other secondary operations in order to manufacture the unit. Each of these additional manufacturing steps adds to the complexity of the hydraulic motor, increasing the manufacturing, maintenance and other costs attendant to the motors. In addition, complicated seals are needed between adjoining housing parts in order to insure the hydraulic integrity of the motor.

The present invention is designed to simplify the construction of hydraulic motors and more particularly hydraulic motors having a rotating valve.

OBJECTS AND SUMMARY OF THE INVENTION

It is an object of the present invention to simplify the construction of hydraulic devices;

It is another object of the present invention to increase the efficiency of hydraulic motors;

It is a further object of the present invention to strengthen hydraulic motors;

It is still another object of the present invention to reduce the cost of hydraulic motors;

It is yet another object of the present invention to increase the adaptability of hydraulic motors;

Other objects and a more complete understanding of the invention may be had by referring to the drawings in which:

DETAILED DESCRIPTION OF THE INVENTION

Figure 1:
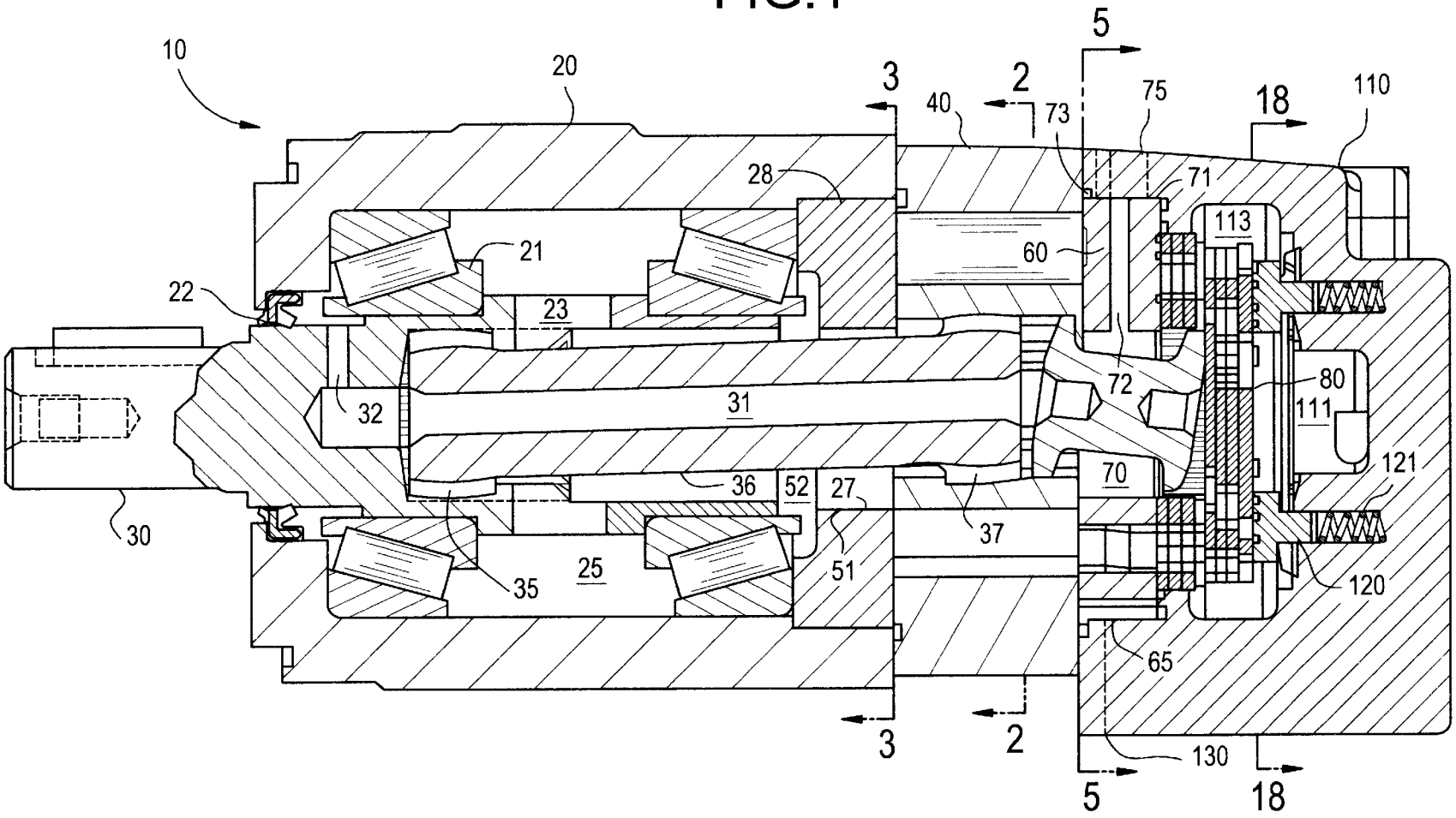
FIG. 1 is a longitudinal cross-sectional view of a hydraulic pressure device incorporating the invention of the application.

This invention relates to an improved pressure device. The invention will be described in its preferred embodiment of a gerotor motor having a rotating valve separate from the gerotor structure.

The invention would also be amenable to gerotor valved gerotor motors such as the White Model RE, shaft valved devices such as the White Model RS, separate wobblestick toe valved devices such as the White Model HB, TRW M Series, and/or other devices.

The gerotor pressure device 10 includes a bearing housing 20, a drive shaft 30, a gerotor structure 40, a manifold 50, a valving section 80 and a port plate 100.

The bearing housing 20 serves to physically support and locate the drive shaft 30 as well as typically mounting the gerotor pressure device 10 to its intended use such as a cement mixer, mowing deck, winch or other application.

The particular bearing housing of FIG. 1 includes a central cavity having two roller bearings 21 rotatively supporting the drive shaft therein. A shaft seal 22 is incorporated between the bearing housing and the drive shaft in order to contain the operative hydraulic fluid within the bearing housing 20. Due to the later described integral drain for the cavity 25 within the bearing housing 20 this shaft seal 22 can be a relatively low pressure seal. The reason for this is that the later described drain reduces the pressure of the fluid within the cavity 25 from full operational pressure, typically 2,000–4,000 PSI, down to a more manageable number, typically 100–200 PSI. The use of roller bearings 21 in the pressure device encourages the flow of fluid within the cavity 25 due to the fact that the bearings 21 inherently will move fluid from their small diameter section to their large diameter section. This facilitates in the lubrication and cooling of these critical components. In addition to the above, a series of radial holes 32 in the drive shaft further facilitates the movement of fluid within the cavity 25 across the bearings 21.

Note that due to the fact that the bore or cavity 25 of the bearing housing 20 has a set of reducing size diameters with no blind grooves or increasing size diameters, it is possible to machine the bearing housing from one side thereof at a single machine with a single setup. This insures the alignment of all of the bores of the bearing housing 20 (i.e. the four steps shown) in addition to reducing the complexity and cost of manufacture of this part.

Figure 8:
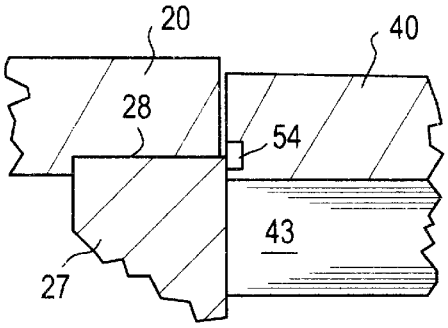
FIG. 8 is an enlarged representational view of the orientation of the edge of the wear plate to the edge of the housing in FIG. 1 prior tightening of the assembly bolts.
Figure 9:
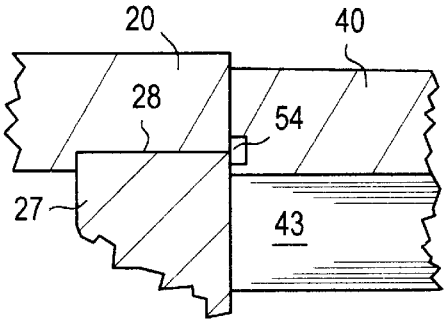
FIG. 9 is a view like FIG. 8 after the tightening of the assembly bolts.

A wear plate 27 completes the bearing housing 20. This wear plate is a separate part from the bearing housing 20. As such it can be, and preferably is, made of different materials than the housing proper. Further, the wear plate 27 has a axial length slightly greater than the cavity 28 within which it is inserted. This allows the wear plate 27 to be axially clamped between the later described gerotor structure 40 and the remainder of the bearing housing 20 (while also allowing a solid bedding contact therebetween outside of such wear plate as later described). This construction serves to strengthen the housing as well as reducing the leakage from the pressure cells of the gerotor structure, thus improving the efficiency of the gerotor motor (contrast FIG. 8 with FIG. 9). The wear plate 27 in addition serves to lock the bearings 21 in place in respect to the bearing housing 20 eliminating the need for a separate retainer.

The difference between the axial length of the wear plate 27 and the cavity 28 within which it is inserted is primarily based on the modulus of elasticity (Young's modulus) between the materials of the wear plate and housing in combination with the compressive stress-strain curve for both materials. This will insure that the captured part will be compressed without the device being physically damaged during assembly and/or subsequent use. (See the explanation of material properties in the full text of, and particularly the stress-strain section, of *Mark's Handbook for Mechanical Engineers* Published by McGraw-Hill of New York, N.Y., incorporated by reference for explanation of stress-strain curves and Young's modulus.) In addition, the thickness/length/area of any relatively uncompressed sections must be considered; with too elastic a plate 27, bowing may exist. Therefore, the dimensions and function of the remainder of the device should also be considered. (It may also be determined on the basis of experimentation or otherwise if desired.)

In the particular preferred embodiment disclosed, the bearing housing 20 is made of ductile steel having a Young's modulus of elasticity of $23.6\times10^6$ lbs./square inch while the wear plate 27 is a powder metal part having a Young's modulus of elasticity of $18\times10^6$ lbs./square inch. By having the wear plate 27 a powder metal part, the natural porosity thereof aids in the lubrication of the rotor 45 of the later described gerotor structure 40, thus increasing the mechanical efficiency of the overall device. The axial length of this wear plate 27 is selected such that with designed assembly torque on the main housing bolts that hold the device 10 together, the stator 41 bearingly engages the bearing housing radially outward of the wear plate 27 (contrast FIG. 8 bolts not tightened with FIG. 9: bolts tightened—gap shown out of scale for clarity of presentation). In the embodiment disclosed, this axial length is 0.001" to 0.003" greater than the cavity 28 within which the wear plate 27 is located (up to 0.010" could be utilized in this example). This allows the stator 41 of the gerotor structure 40 to fully seat against the bearing housing 20. It also allows for the use of a single simple face seal 54 between the housing 20 and the stator 40 to seal this location—a joint of three parts, reducing manufacturing and maintenance costs. Indeed, the wear plate 27 could be left out without effecting the hydraulic integrity of this seal under pressure.

The wear plate 27 shown is some 3" in diameter and 0.65" in axial length with a 1.280" central hole therein. The preferred wear plate 27 is some 0.005" to 0.010" smaller in diameter and 0.001" to 0.003" longer in axial length than the cavity 28 in which it resides. (Note that the 0.65" total axial length of the wear plate 27 is such that no compensation to reduce bowing is needed, in contrast with the later described manifold 60.) A further 2" diameter and 0.145" depth clearance groove on the inside surface thereof allows the wear plate to contact only the outer race of the bearing stack, thus allowing relatively unfettered rotation of the bearings 21. A small 0.062" alignment slot 26 and similar slot 24 in the inner surface of the bearing housing 20 allows a small pin to be inserted to initially lock the two in relative rotary position. This insures that upon clamping assembly the roll recesses 29 and balancing recesses 31 will be properly aligned with the rolls 43 and gerotor cells 47 of the adjoining gerotor structure 40. The roll recesses 29 are 0.375" in diameter and 0.035" in depth, axially aligned with an adjoining stator roll 43 (themselves some 0.5" in diameter on a 2.30" diameter bolt circle). These recesses reduce the axial pressure on the rolls 43 while still providing for a relative seal between adjoining gerotor cells 47. The balancing recesses 31 are aligned with the gerotor cells 47 (and later described manifold openings), extending 0.4" wide and 0.250" high and some 0.020" deep on a 1.125" circle. These balancing recesses 31 serve to reduce chattering in the gerotor structure 40.

The wear plate 27 shown, some 0.003" greater in axial length than the cavity 28 within which it is located, is under the pressure of four 0.375" diameter grade 8 bolts having national fine threads (24 per inch). When tightened to 50 foot lbs. of torque, each bolt produces approximately 9,800 lbs. of force. This force compresses the wear plate 27 sufficiently to solidly seat the bearing housing 20 to the stator 41. Further, the resistance of the wear plate 27 to being compressed aids in retaining the bolts in place by preloading same.

The drive shaft 30 is rotatively supported within the bearing housing 20 by the bearings 21. This drive shaft serves to interconnect the later described gerotor structure 40 to the outside of the gerotor pressure device 10. This allows rotary power to be generated (if the device is used as a motor) or fluidic power to be produced (if the device is used as a pump). In addition to the previously described radial hole 32, a hole 33 drilled in the radial surface of the drive shaft 30 and the pumping action of the radial bearings 21 facilitate the movement of fluid throughout the cavity 25 thus to further facilitate the lubrication and cooling of the components contained therein. The drive shaft 30 includes a central axially located hollow which has internal teeth 35 cut therein. The hollow provides room for the wobblestick 36 while the internal teeth 35 drivingly interconnect the drive shaft 30 with such wobblestick 36. Additional teeth 37 on the other end of the wobblestick drivingly interconnect the wobblestick 36 to the rotor of the later described gerotor structure, thus completing the power generating drive connection for the device. A central hole 31 drilled through the longitudinal axis of the wobblestick 36 further facilitates fluid communication through the device.

Figure 2:
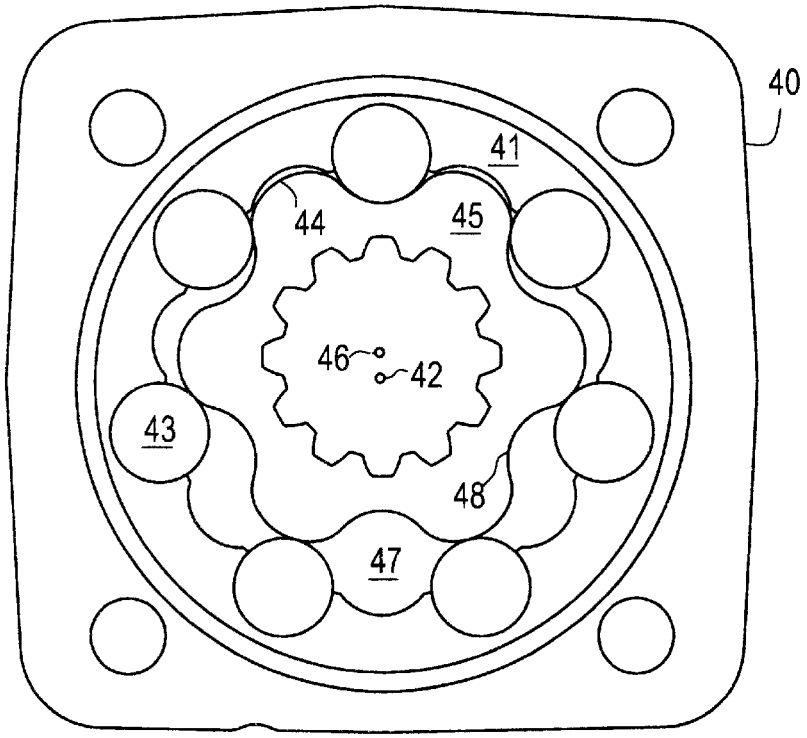
FIG. 2 is a lateral cross-sectional view through the hydraulic pressure generating gerotor structure of FIG. 1 taken substantially along the lines 2—2 in such figure.

The gerotor structure 40 is the main power generation apparatus for the pressure device 10 (FIG. 2). The particular gerotor structure 40 disclosed includes a stator 41 and a rotor 45 which together define gerotor cells 47. As these cells 47 are subjected to varying pressure differential by the later described valve, the power of the pressure device 10 is generated. This occurs because the axis of rotation 46 of the rotor is displaced from the central axis 42 of the stator (the wobblestick 36 accommodates this displacement). As the rotor 45 moves, the inner section of the lobes 48 of such rotor define an inner limit circle 49. This inner circle 49 defines the innermost extension of the gerotor cells 47. In the invention of the present application, there are fluid passages 50 which extend from this innermost extension 49 to the central area 52 within the pressure device 10. Due to this extension, an amount of fluid can be parasitically drawn off of the cells 47 to pass into the central area 52. This serves simultaneously to lubricate the critical moving components of the pressure device 10 in addition to providing a cooling and lubrication function therefor.

Figure 3:
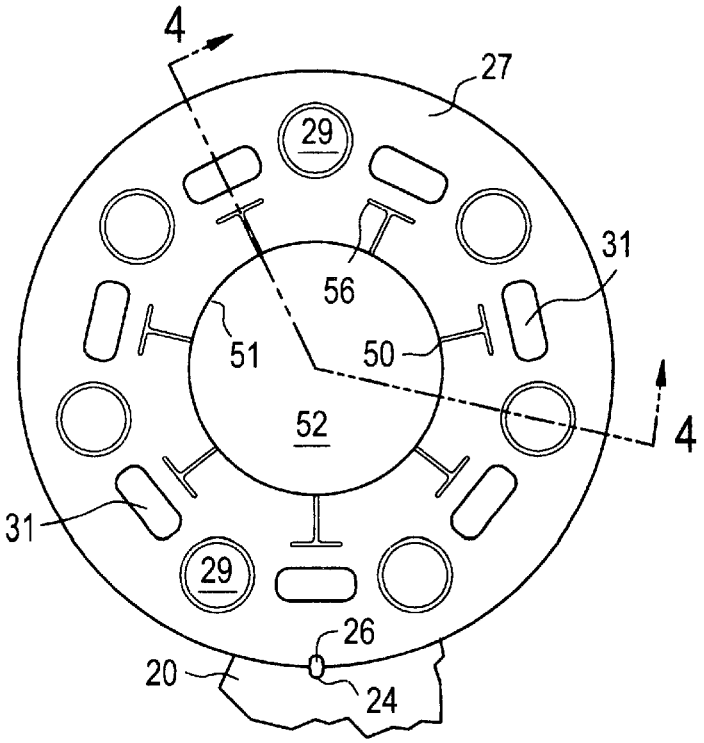
FIG. 3 is a cross-sectional view of the wear plate of the embodiment of FIG. 1 taken generally from line 3—3 in that figure.
Figure 4:
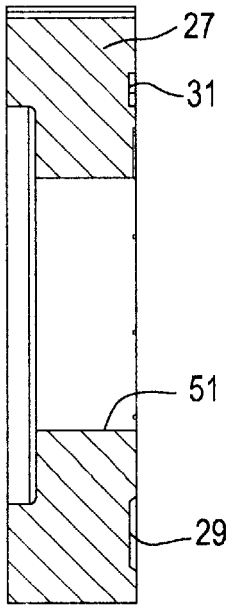
FIG. 4 is a cross-sectional view of the wear plate of FIG. 3 taken generally from line 4—4 in that figure.

In the preferred embodiment disclosed in FIG. 1, these passages 50 are "T" slots formed in the surface of the wear plate 27 adjoining the gerotor structure 40 (see FIG. 3). With the slots so positioned, there is one slot interconnected to the dead pocket in a top dead center position rotor with a second slot 53 leaking to the central area 52 of the pressure device. In a corresponding bottom dead center position, there is again one leakage path going to the dead pocket and a further slot 54 starting to have leakage to the central area 52. The radial extension 55 at the outer end of the passages 50 allow for an increased amount of leakage over a longer period of time than would be possible with a straight laterally extending passage 50 (i.e. without the radial extension 55). This facilitates the continuity of the flow of the lubrication fluid into the central area 52 of the device. The location of the passages 50 in the wear plate 27 is preferred to a location in the later described manifold due to its axial separation from the later described pressure release mechanism in the rotating valve of the valving section 80. Note that although the passages 50 are shown located in a non-moving part, the wear plate 27, they could also be located in the rotor 45 as long as the same conditions are met—i.e. there is a leakage path from the gerotor cells 47 into the central area 52 of the device. This would be accomplished by placing a small inwardly extending passages 58 within the rotor 45, preferably at the base of the lobes thereof, sufficiently long enough to extend into the central hole of the wear plate 27 or later described manifold 60 thus to provide for the desired leakage.

Figure 5:
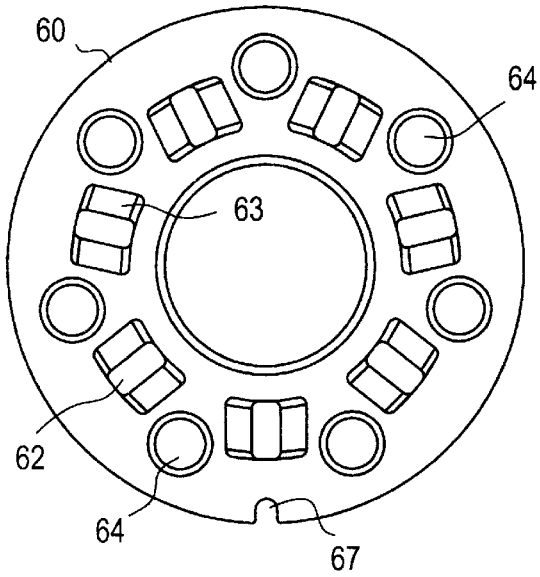
FIG. 5 is a cross-sectional view of the manifold plate of the embodiment of FIG. 1 taken generally from line 5—5 therein.
Figure 6:
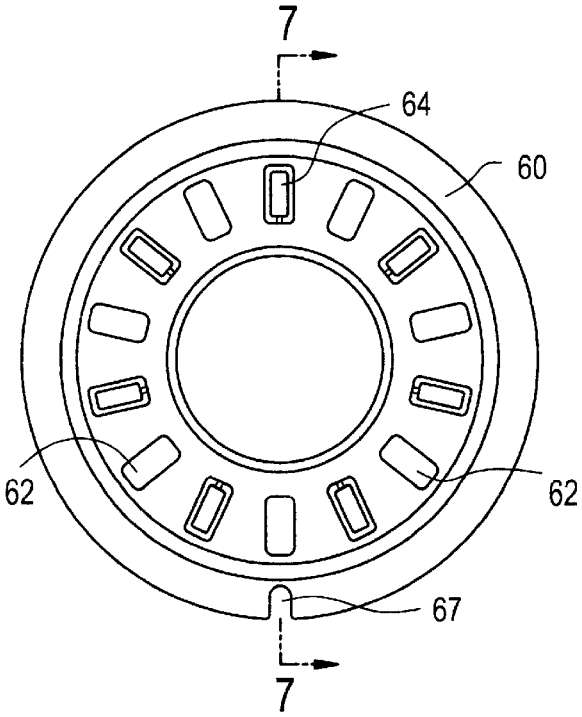
FIG. 6 is a lateral face view of the back side of the manifold plate of FIG. 5 taken generally along lines 6—6 in FIG. 7.
Figure 7:
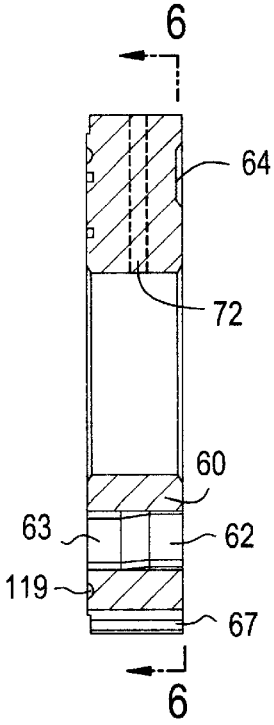
FIG. 7 is a lateral cross-sectional view of the manifold plate of FIG. 1 taken generally from lines 7—7 in FIG. 6.

The manifold 60 in the port plate 100 serves to fluidically interconnect the later described valve to the gerotor cells 47 of the gerotor structure 40, thus to generate the power for the pressure device 10. In the particular embodiment disclosed, since the valve is an orbiting valve, phase compensation is not necessary. As such, the through valving passages 62 can extend straight through the manifold 60. With differing valving mechanisms such as the valve in rotor of the White Model RE or the separate wobblestick toe driven orbiting valve of FIG. 20 or the TRW M Series, phase compensation may be included in the manifold (typically 90° or so). With a shaft valve such as that in the White Model RS, the positions of the wear plate 27 and manifold 60 may be reversed (see FIG. 18). The particular manifold disclosed includes recesses 64 directly centered on the rolls 43 of the stator 41 (FIGS. 5–7). These serve to reduce the axial pressure on such rolls 43 while maintaining a good seal between adjoining gerotor cells 47 (corresponding recesses 29 and the wear plate 27 provide a similar function at the other end of the rolls 43). In addition, the manifold opening 61 are expanded at their interconnection with the gerotor cells 47 relative to the openings of the through valving passages 62 on the other side of such manifold (contrast FIG. 5 with FIG. 6). (Balancing recesses 31 in the wear plate 27 serve to equalize the pressure on the other sides of the rotor 45).

As with the wear plate 27, the axial length of the manifold 60 is preferably greater than the axial length 65 of the cavity in the port plate 110 within which it is contained as previously set forth: this serves to clamp the gerotor structure 40 with pressure on both sides thereof, thus to reduce leakage and improve the overall mechanical efficiency of the pressure device. Similarly, the manifold 60 is of powder metal construction. A small groove 119 extending about the manifold 60 adjacent to the outer circumference of the valve 80 provides clearance for any incidental burrs thereon.

By having the manifold 60 a powder metal part, again as with the wear plate 27, the natural porosity thereof aids in the lubrication of the rotor 45 of the later described gerotor structure 40, thus increasing the mechanical efficiency of the overall device. The axial length of this manifold 60 is selected such that with normal torque on the main housing bolts that hold the device 10 together, the stator 41 engages the port plate 110 radially outward of the manifold 60. It is preferred that this axial length be similar to that of the wear plate 27 so as to provide for substantially equal forces on both sides of the gerotor structure 40. In the embodiment disclosed this axial length is again 0.001" to 0.003" greater than the cavity within which the manifold 60 is located. This allows the use of a second single simple face seal 73 to seal this location, reducing manufacturing and maintenance costs. Indeed, the manifold 60 could be left out without effecting the integrity of this seal (Note that this seal 73 could be located symmetrically with the wear plate seal. However, as later described, this would disturb the function of the centering of contact area on either side of the manifold (via ring 115) due to the reduction of the area 117 outside of such ring 115. This would necessitate movement/redesign of the ring 115 to provide is function).

The outer diameter of the manifold is 0.005" to 0.010" smaller than the inner diameter of the port plate 110 surrounding the same and 0.001" to 0.003" longer in axial length than the cavity within which it resides. Again the axial length oversize was determined based on the modulus of elasticity in combination with the other factors set forth in respect to the wear plate 27.

In order to facilitate the cooperation between the captured part and neighboring pieces, it is possible that at least one of the adjoining elements in compressive contact would have a reduced surface area in respect to the total area otherwise available (i.e. the full overlapping of adjoining surfaces). This reduced surface area increases the unit loading, thus to facilitate the compression process. The surface area of contact can therefor be adjusted to such a certain cooperation of parts and/or the location and amount of resulting forces. Adjustments include a) the materials (i.e. relative Young's modulus), b) the materials dimensions including thickness and diameter, c) the value of the compressive forces, d) the total surface area of contact, e) the concentration of the area of contact over the surface area of contact available (for example a single narrow groove vs. knurling the entire surface area to produce the same area of contact, f) the symmetry of the area of contact, g) the location of the area of contact, h) the direction of the compressive force, and, i) the concentration of the compressive force and other variables.

For example, in the case of the manifold 60 there normally would be a contact area with the port plate 110 of some 1.5 square inches (the outer diameter of the manifold 60 being 2.9" and the inner diameter of the port plate 110 about the valve 80 being 2.55"). As there if 9800 foot pounds of loading on four bolts (39,200 pounds total) the pressure on the contact area normally would be 26,133 pounds per square inch. However, as later set forth, in this embodiment the contact area is reduced to a 2.5" center to center diameter ring 115 some 0.030" in width. This reduces the surface area to 0.245 square inches. With the same loading this produces a revised pressure on the reduces contact area of 160,000 pounds per square inch—a unit loading over six times greater than before. This allows for an adjustment of the amount of unit loading.

This reduced surface area is preferably provided first in the element having the higher modulus of elasticity. This lowers the chances of structural damage to the reduced area. It also increases the volume of material available in the other element to absorb the increased loading (this in recognition of its lower strength). Note that with certain combinations of materials it is possible for the reduction in surface area to increase the unit loading so far that the combination is self-destructive. Therefor a limit exists that such destruction not occur during the designed service life of the device containing the elements. This life including the extra margin of life normally included in the device.

The actual reduction in surface area can be provided by grooves, slots, cross-hatching, impressed dimples, knurling or other technique as previously set forth. The choice depends primarily on the materials to be utilized together with other design criteria.

In respect to materials, in general the closer the modulus of elasticity between materials, the higher the ratio can be between the reduced surface area to the full available area and the higher a given individual point of loading can be (it being assumed that the full available area is itself greater than that necessary to transfer the loading without destruction of either elements; if it is not no reduction is possible). The reason for this is that the materials having similar values are less likely to destroy each other under higher unit loading. In respect to design, the thicker the materials and the closer the transfer of forces is compression of the elements (as opposed to angular, shear, etc.) the greater the unit loading can be. The reason for this is both that materials are typically stronger with straight compression loads and that any angular forces reduce this strength. These angular forces also might compromise the location and/or operation of the involved parts (and/or others).

Figure 10:
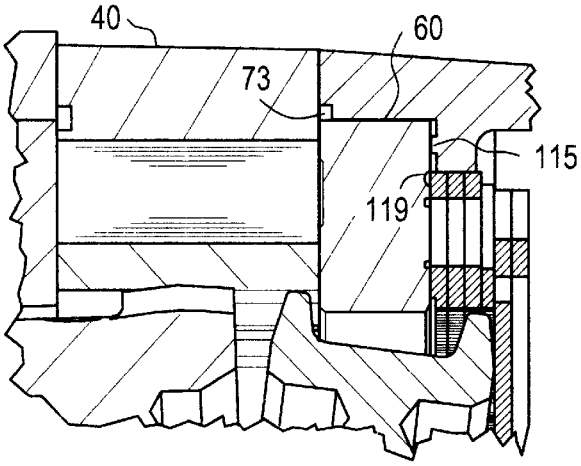
FIG. 10 is an enlarged view of the top of the manifold in FIG. 1 highlighting the limited contact thereof.
Figure 11:
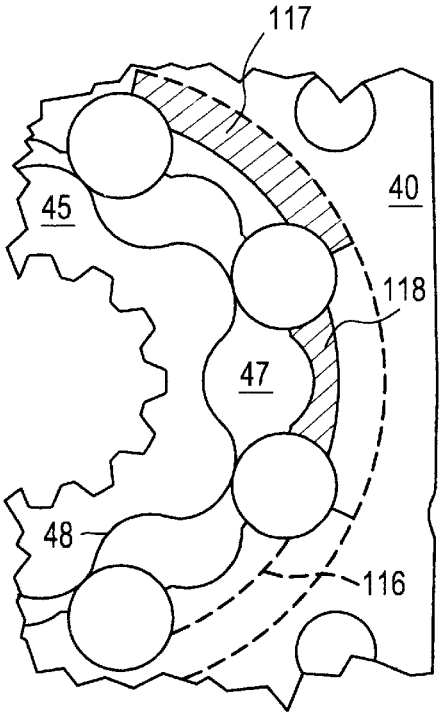
FIG. 11 is a view of the stator of FIG. 10 detailing the orientation of the limited contact of the manifold therewith.
Figure 12:
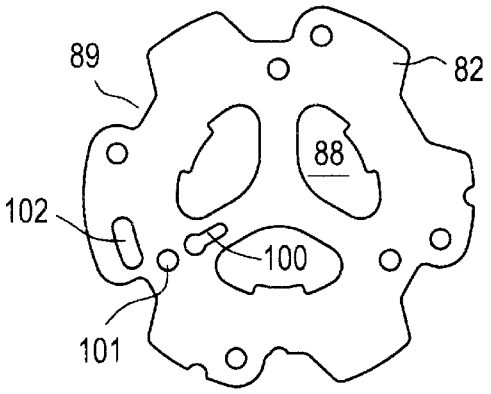
FIGS. 12–16 are selective cross-sectional views of the plates in the rotating valve of the gerotor device of FIG. 1.
Figure 13:
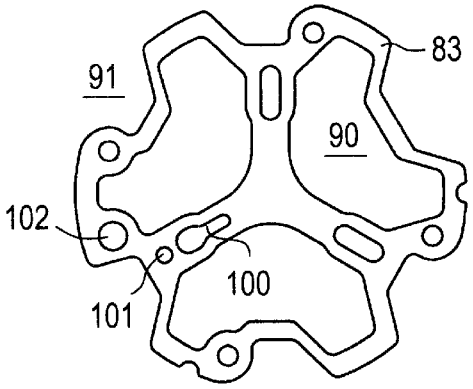
Figure 14:
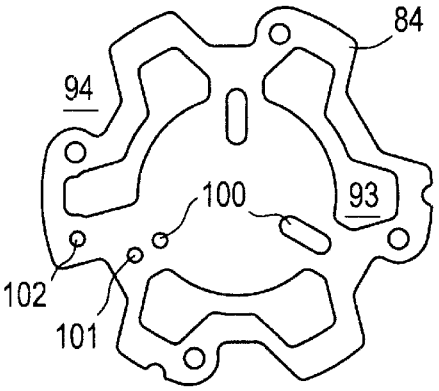
Figure 15:
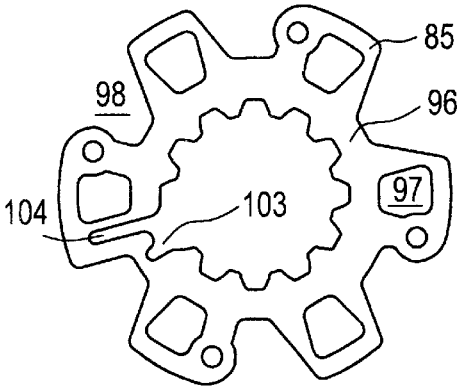
Figure 16:
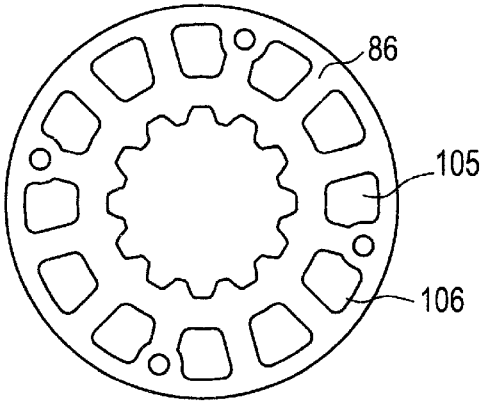
Figure 17:
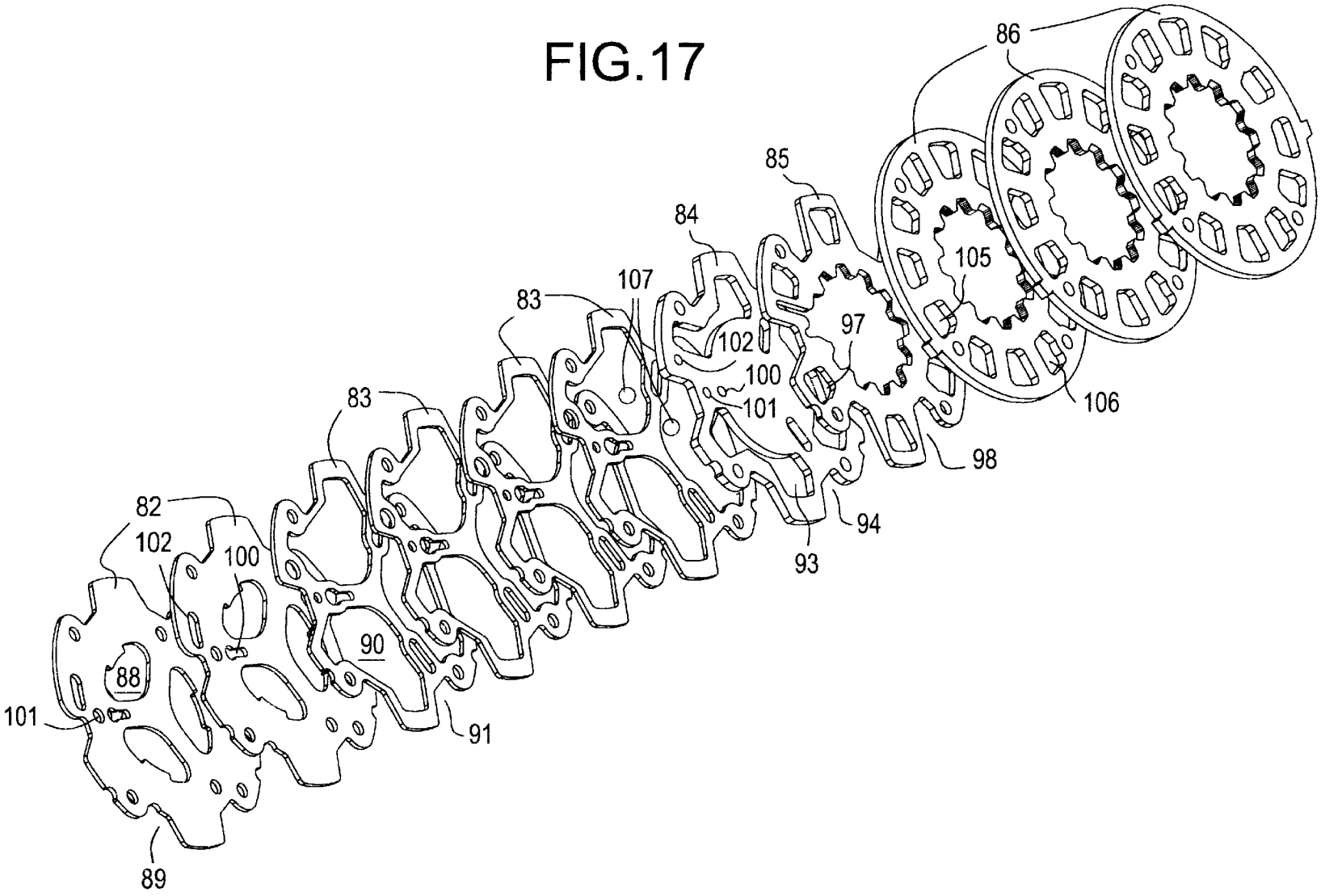
FIG. 17 is a perspective view of the plates of FIGS. 12–16 prior to assembly into a valve; and, FIGS. 18–20 are cross-sectional views of a modified White motors incorporating embodiments of the invention.

As an example of the above, the particular manifold 60 shown is thinner than the wear plate 27 while being the same material. In the particular preferred embodiment this would ordinarily cause the manifold 60 to bow slightly towards the rotor 45, potentially reducing the mechanical efficiency for the device. The reduced contact area between the port plate 110 and the manifold 60 also reduces this bowing by machining the ring 115 at a certain location between the surfaces of contact therebetween. In specific the ring 115 is located such that the contact area between the manifold 60 and stator 41 outside 117 of a circle 116 equal in diameter to the center of the ring 115 is substantially the same as the contact area between the manifold 60 and stator inside 118 such circle (FIGS. 10 and 11). The ring 115 is thus located substantially in the center of the area of contact with the stator on the opposite side of the manifold 60. This balances out the forces on either side of the manifold (i.e. both contacts are located on the same radius from the center of the manifold, albeit with different surface area). This reduces the loading imbalance of the manifold and thus any bowing tendency. Alternately, the manifold 60 could have been made 0.10" to 0.20" thicker.

The manifold 60 shown is some 2.9" in diameter and 0.56" in axial length with a 1.170" central hole therein. A small 0.125" alignment slot and similar slot in the inner surface of the port plate 110 lock the two in relative rotary position. This insures that upon clamping assembly the roll recesses 64 and manifold openings 61 will be properly aligned with the rolls 43 and gerotor cells 47 of the adjoining gerotor structure 40. The roll recesses 29 are 0.375" in diameter and 0.035" in depth, axially aligned with an adjoining stator roll 43 (themselves some 0.5" in diameter on a 2.30" diameter bolt circle). These recesses reduce the axial pressure on the rolls 43 while still providing for a relative seal between adjoining gerotor cells 47. Again, the manifold is subjected to the approximately 9,800 lbs. of force per each of the four main assembly bolts to compress such plate. The circle 116 is located a a 1.30" radius with the ring 115 itself 0.030" wide and 0.040" above the remainder of the port plate 110.

The valving passages complete the manifold 60.

On one side of the manifold there are narrow valving passages 62 alternating with a series of balancing recesses 63. These are both substantially equal size and equally spaced 0.168" wide and 0.348" long on a 1.128" radius circle. The balancing recesses 63 extend some 0.035" deep in a groove extending some 0.040" wide about the perimeter of the recess. (The center portion of the recesses extend to the surface of the manifold 60—full area depth is not necessary to provide the balancing function: the center portion aids in supporting the rotary valve 81.)

On the other side of the manifold there are broad manifold openings 61 alternating with a series of balancing recesses 64. The manifold openings 61 are substantially 0.470" wide and 0.348" long on a 1.128" radius circle. (There is a transition between the narrow valving passages 62 and the wider manifold openings by an angular transition section in the middle third of the manifold 60. The difference provides for accurate valving on one side and maximum flow/low pressure drop on the other.) The balancing recesses 64 are again 0.375" in diameter and 0.035" deep centered on the rolls 43 of the gerotor structure on a 2.30" bolt circle.

The combination of wear plate 27 and manifold 60, trapped as they are, provide for increased manufacturing efficiency (being of pressed metal and not forged or machined), increased mechanical and pressure efficiency (by reliably and predictably closing and lubricating both sides of the gerotor structure 40) and increased serviceability (replacing the two parts in combination with at least the rotor (and in some cases the stator) produces the equivalent of a new gerotor structure.

The manifold 60 in the port plate 110 also can serve as a location for an additional/alternate dedicated leakage path. Although not preferred as a location for a leakage path (due to its proximity to the case drain in the valve) it was discovered that the area 71 immediately surrounding the manifold 60 was subjected to high pressure when the outer port 113 pressurized, primarily via leakage past the outer surface of the valve 80. This provided a relatively convenient source or lubrication fluid for a leakage path. In addition a leakage path at this location would lower the relative pressure at this location (and on the seal 73). The inclusion of a hole 72, or series of holes 72, from this area 71 to the center 70 of the manifold 60 provides this. (If the outer port 113 is connected to low pressure, since the later described case drain in the valve would be. Also, the hole 72 is relatively pressure balanced between its inner and outer ends. It would thus not compromise the volumetric efficiency of the device under this alternate connection.) The aggregate cross-sectional size of the hole(s) 72 is preferably selected such that it is larger than the smallest of the leakage path from about the valve 80 to the area 71 on the outside circumference of the manifold 60. This allows the fluid to drain from such area 71 to the center 70 of such manifold 60 without relative restriction. Note, however, that in certain applications it may be appropriate to size the hole 72 such that it does limit flow—for example where such flow would unduly compromise the volumetric efficiency of the device or where a back pressure is desired (typically for a secondary purpose). The particular hole has a diameter of about 3/16 of an inch, providing about 0.25 gallons of lubrication fluid for a 25 gallon input. This hole 72 may be included in addition to or instead of the previously described first dedicated leakage passage.

The second fluid leakage passage 72 in the manifold 60 could also form part of a separate case drain for the hydraulic device (for use with or instead of the later set forth valve case drain). This would be attractive for applications wherein a separate drain line isolated from the valve 80 or ports 110, 113 is desired. To provide for this separate case drain a drain port 75 would be located extending from the area 71 to the outside of the device, preferably directly radially outwards so as to simplify its manufacture. The drain port 75 would be threaded or otherwise rendered into a form for an external drainline (not shown). Multiple holes 72 would be preferred on an outer circumferential groove so as to increase the connection dwell time between the port 75 and the center 70 of the manifold 60 (via holes 72). This drain port 75 would simultaneously lower the unit pressure on the area 71 (especially if port 113 is pressurized) while also providing for a case drain for the center 52 of the device 10. This simplifies the device while simultaneously reducing the design limits of the parts therein. Towards this end if the first set of dedicated leakage paths is eliminated it is preferred that longitudinal hole 31 be included in the wobblestick 36 (FIG. 1). This hole 31 allows movement of fluid down the center of the wobblestick towards the drive connection 35, such movement assisted by the centripetal radial forces on the fluid provided by hole 32 and the previously described pumping action of the front bearing 21. The holes 23 and the back bearing 21 further encourage movement of fluid in the center of the device and across the back drive connection 37. These connections are cooled and lubricated by this fluid flow.

The valving section 80 selectively valves the gerotor structure to the pressure and return ports. The particular valve 81 disclosed is of brazed multi-plate construction including a selective compilation of five plates (FIGS. 12–17). The particular valve 81 is a eleven plate compilation of two communication plate 82's, four first transfer plates 83, a single second transfer plate 84, a radial transfer plate 85 and three valving plates 86.

The communication plate 82 contains an inner area 83 which communicates directly to the inside port 111 in the port plate. The communication plate 82 also contains six outer areas 89 which are in communication with the outside port 113. The plate thus serves primarily to interconnect the valve 81 to the pressure and return ports of the gerotor pressure device 10.

In order to provide for the necessary alternating passages 105, 106 in the valving plate 86, the first and second transfer plates 83, 84 shift the fluid from the inner 88 and outer 89 areas.

The first transfer plate 83 contains a series of three first intermediate passages 90 which serve to begin to transfer fluid from the inner area 88 outwards. It also includes a series of six second outward passages 91 which communicate with the outer areas 89 in the communication plate to laterally transfer fluid. Since the outside port 113 directly surrounds the valve 81, these passages 91 also serve to interconnect to the outside port 113.

A second transfer plate 84 completes the movement of the fluid from the inner and outer areas of the communication plate 82. It accomplishes this by a series of three second intermediate passages 93 which serve to complete the radial movement of fluid from the inner area 88 of the communication plate 82. A set of third outer passages 94 interconnect with the second outward passages 91 in the transfer plate 83 and the first outer area 89 in the communication plate 82 to complete the lateral movement of fluid therefrom. Again, since the outside port 113 surrounds the valve, the third outer passage 94 also directly interconnects to the outside port 113.

The radial transfer plate 85 segments the second intermediate passages 93 so as to provide for the alternating valving passages in the valving plate 86. This is provided by cover sections 96 for the middle of such passages 93. This separates the two passages 97, 98 therein to initiate alternated placement thereof.

The valving plate 86 contains a series of alternating passages 105, 106 which terminate the inner 88 and outer 89 areas of the commutation plate 82 to complete the passages necessary for the accurate placement of the valving openings in the device. In the valving plate 86 the first 105 of the alternating valving passages is thus interconnected to the inside port 111 while the second 106 of the alternating passages is connected to the outside port 113 by the previously described passages.

Due to the use of a multiplicity of plates, the opening available for fluid passage is increased over that which would be available if only a single plate of each type was utilized.

In addition to the above valving function, the valving section 80 also includes a pressure release mechanism for the central area 52 of the gerotor pressure device. This pressure release mechanism includes three through holes 100–102, each containing a ball check valve 107, in combination with two valve seats. The holes 100–102 extend through the communication plate 82 and transfer plate 83, 84. These holes service to allow for the passage of fluid through the valve 81 in addition to providing a physical location for the two balls 107 contained within the holes 100–102. The balls 107 themselves cooperate with two valve seats in plate 84 in order to interconnect the central area 52 to the inside port 111 or outside port 113 having the lowest relative pressure. This provides for a self-contained case drain for the cavity 25 of the hydraulic device, thus allowing the circulation of fluid therein as well as lowering the pressure thereof. Of the two valve ball retaining holes, the outermost is interconnected to the outside port 113 while the inner hold interconnects to the inside port 111. The middle hole sweeps the area covered by the later described balancing piston 120. Due to the fact that the valve seats and middle hole are connected to the central area by passages 103, 104 in the radial transfer plate 85 respectively, the fluid in the cavity 25 is free to flow to the port having the lowest relative pressure. By integrating these pressure release valves with the rotating valve, the overall complexity and cost of the gerotor pressure device. Note it desired multiple leakage paths could be provided—for example to include two more sets of holes 100–102 on 120° and 240° spacing from the first set (with the appropriate arms in the plates slightly widened to provide for same).

The valve 81 is itself rotated by a valve stick interconnected to the rotor 45 and thus through the wobblestick 36 to the drive shaft. This provides for the accurate timing and rotation of the valve 81.

A balancing piston 120 on the port plate 110 side of the valve 81 separates the inside port 111 from the outside port 113, thus allowing for the efficient operation of the device. This balancing ring is substantially similar to that shown in the U.S. Pat. No. 3,572,983, Fluid Operated Motor.

The port plate 110 serves as the physical location for the valving section 80 in addition to providing a location for the pressure and return ports (not shown). It thus completes the structure of the gerotor pressure device 10. Note that in this port plate 110 again the bore about the manifold 60 and the plates 86 of the valve 80 together with the groove for the balancing piston 120 can be machined by a single machine with a single setup, again reducing the cost of this part while insuring the alignment of all bores (i.e. two steps and a groove). The ports 111 and 113 together with their fittings are relatively non-critical, having no low tolerance high placement accuracy requirements. Note also that there are no passages, check valve seats, access plug fittings or other fluidic opening machined in the body of the housing of the device; only the threaded holes for the fittings to the two ports 111, 113 need be especially machined. The device is thus very simple compared to the complicated machined housings of the art cited in the prior art section of this application.

Although the invention has been described in its preferred form with a certain degree of particularity, it is to be understood that numerous changes can be made without deviating from the invention as hereinafter claimed.

Figure 18:
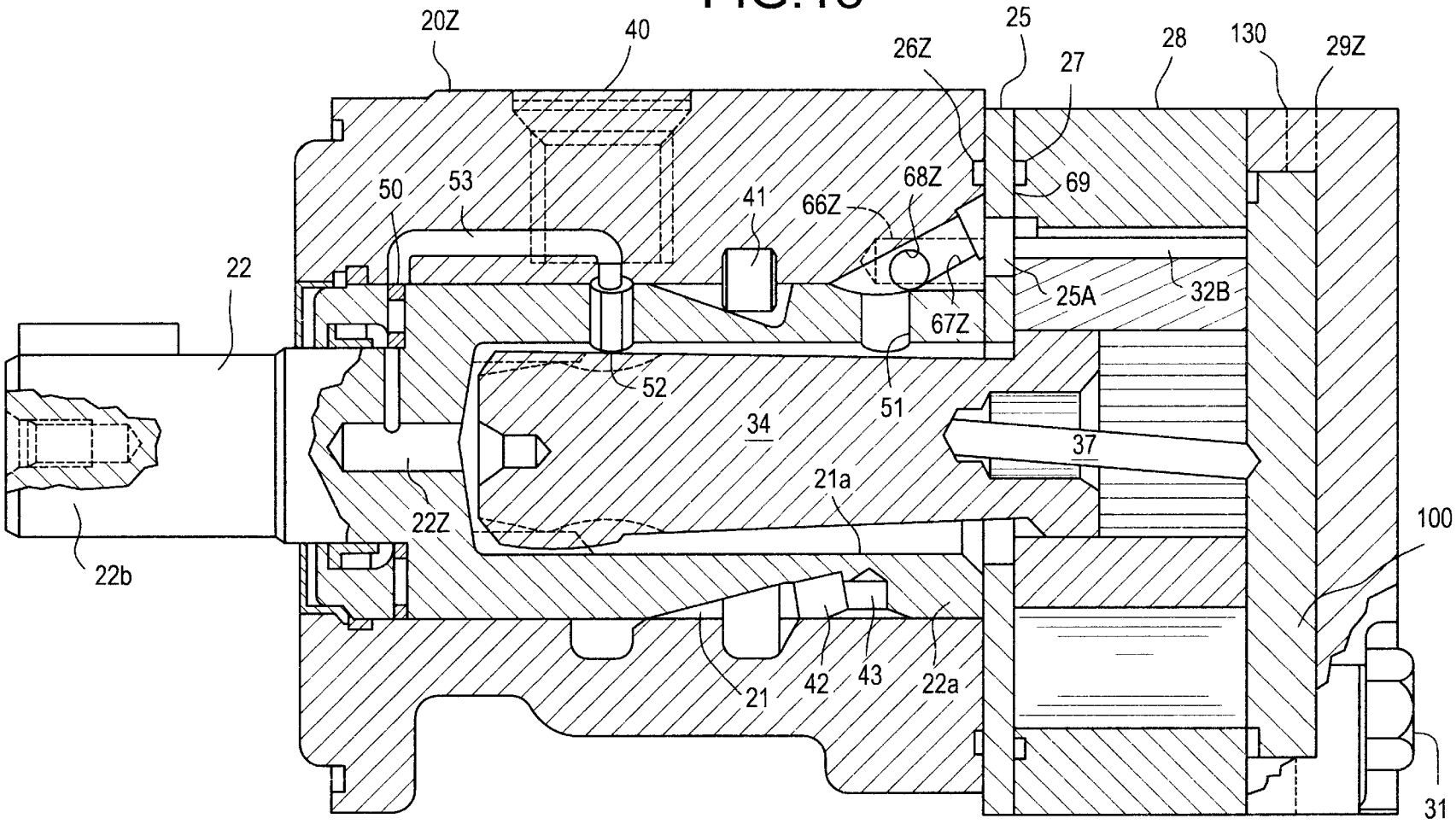
Figure 19:
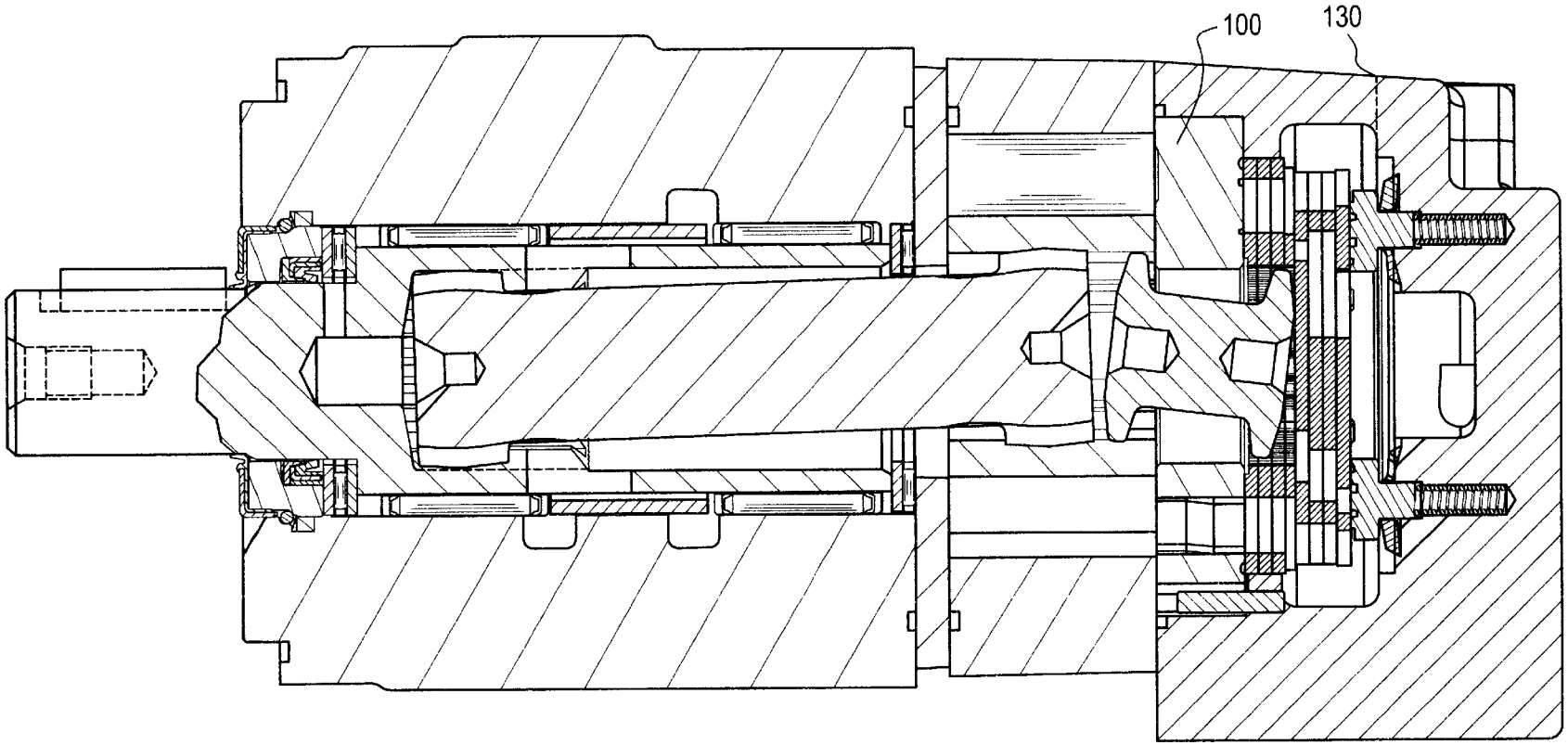
Figure 20:
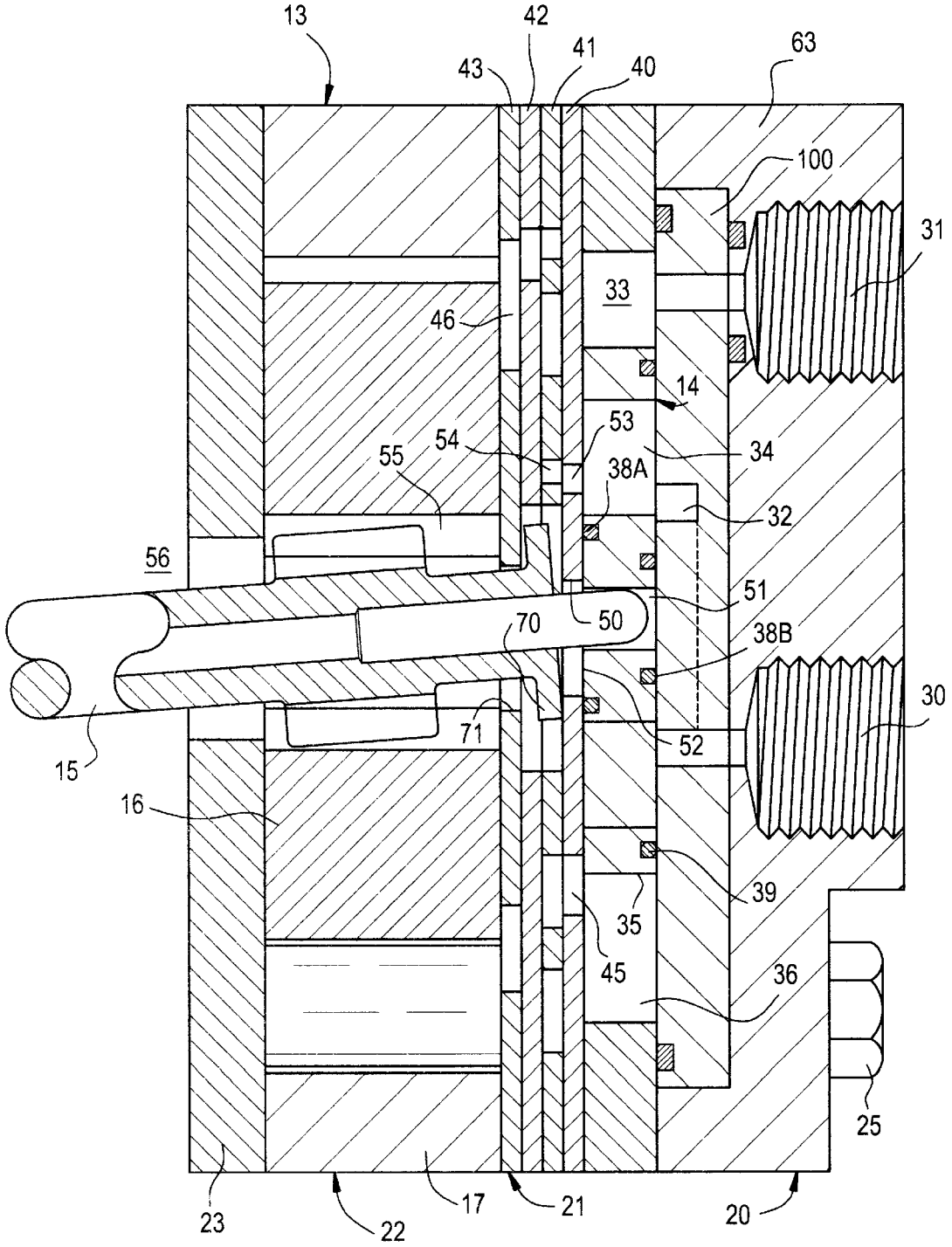

Examples are set forth in FIGS. 18, 19 and 20 which are variations of the White Model RS (U.S. Pat. No. 4,285,643) (FIG. 18), the embodiment disclosed in FIG. 1 herein (FIG. 19) and HB (U.S. Pat. No. 4,877,383) (FIG. 20) the contents of which are included by incorporation. In the FIGS. 18 and 20, the plates 100 are dimensioned in respect to their respective cavities so as to bow out slightly towards a moving part on assembly of the device (the rotor in FIG. 18 and the valve in FIG. 20). Both plates are approximately 0.375" thick. This bowing out biases the moving part so as to aid in the equalization of fluidic pressure thereon (FIG. 18) or to aid in the equalization of the mechanical pressure and sealing (FIG. 20). The manifold in FIG. 19 is substantially the same as the manifold 60 herein except that it is made of steel. Further in any embodiment the joint between surrounding housing parts could be the confines of the manifold (dotted lines 130—FIGS. 18–20—these new joints could replace on supplement those adjoining).

Other modifications are also possible.

What is claimed:

1. In a hydraulic pressure device having a two part housing, the improvement of a cavity, said cavity being in the housing, said cavity having a depth axially bounded by the two parts of the housing, a metal plate, said metal plate being compressible, said metal plate having an axial length, said axial length of said metal plate being greater than said depth of said cavity, said metal plate being in said cavity, and means to seat the two parts of the housing on each other to compress said axial length of said metal plate to said depth of said cavity.

2. The hydraulic pressure device of claim 1 wherein the housing is held together by bolts and characterized in that tightening the bolts compresses said metal plate to seat the two parts of the housing together.

3. The hydraulic pressure device of claim 1 wherein said metal part and two part housing each have modulus of elasticity and characterized in that the modulus of said metal plate is lower than the modulus of the two part housing.

4. The hydraulic pressure device of claim 1 wherein said metal plate has a compressive stress/strain curve and characterized in that said metal plate is compressed within the limits of such curve.

5. The hydraulic pressure device of claim 1 characterized in that said metal plate has a planar surface and the two parts of the housing joining at a plane substantially coextensive with said planar surface of the said metal plate.

6. The hydraulic pressure device of claim 1 characterized in that said metal plate has a planar surface and said metal plate adjoining a joint in the housing not coextensive with said planar surface of said metal plate.

7. In a hydraulic pressure device having a two part housing, the improvement of a cavity, said cavity being in the housing, said cavity having a depth axially bounded by the two parts of the housing, a plate, said plate being compressible, said plate having an axial length, said axial length of said plate being greater than said depth of said cavity, said plate being in said cavity, means to seat the two parts of the housing on each other to compress said axial length of said plate to said depth of said cavity, the two part housing surrounding a part, said part having a surface, said cavity having a cavity surface substantially parallel to said surface of said part, said plate having a plate surface, said plate surface overlapping said cavity surface, and at least one of said plate surface or said cavity surface being reduced to provide a reduced surface area of contact therebetween.

8. The Hydraulic pressure device of claim 7 characterized in that said reduced surface area of contact is a ring.

9. The hydraulic pressure device of claim 8 characterized in that said ring is substantially centered on the overlap between said plate surface and said cavity surface.

10. In a hydraulic pressure device having a two part housing, the improvement of a cavity, said cavity being in the housing, said cavity having a depth axially bounded by tire two parts of the housing, a plate, said plate being compressible, said plate having an axial length, said axial length of said plate being greater than said depth of said cavity, said plate being in said cavity, means to seat the two parts of the housing on each other to compress said axial length of said plate to said depth of said cavity, said plate having an outside circumferential surface and an inside opening, and hole means in said plate to connect said outside circumferential surface to said inside opening.

11. The hydraulic pressure device of claim 10 characterized by the addition or a case drain and means in the housing to connect said outside to said case drain.

12. The hydraulic pressure device of claim 10 characterized by the addition of a case drain and means in the housing to connect said inside cavity to said case drain.

13. In a gerotor hydraulic pressure device having a rotor with a surface adjoining a housing and a stator surrounding the rotor, the improvement of a cavity, said cavity being in the housing adjacent to one surface of the rotor, said cavity having a depth, a plate, said plate being compressible, said plate having an axial length, said axial length of said plate being greater than said depth or said cavity, said plate being in said cavity, and the stator Partially closing one side of said cavity, and means to seat the stator to the housing compressing said axial length of said plate to said depth of said cavity.

14. The gerotor hydraulic pressure device of claim 13 characterized in that said plate is a manifold.

15. The gerotor hydraulic pressure device of claim 13 characterized in that said plate is of powder metal.

16. The gerotor hydraulic pressure device of claim 13 wherein the housing is held together by bolts and characterized in that tightening the bolts fully compresses said plate.

17. The gerotor hydraulic pressure device of claim 13 wherein the housing, stator, and plate each have modulus of elasticity and characterized in that the modulus of said plate is lower than either the modulus of the housing or stator.

18. The gerotor hydraulic pressure device of claim 13 wherein said plate has a compressive stress/strain curve and characterized in that said plate is compressed within the limits of such curve.

19. The hydraulic pressure device of claim 13 characterized in that said cavity has a cavity surface substantially parallel to the surface of the rotor, said plate having a plate surface, said plate surface overlapping said cavity surface, and at least one of said plate surface or said cavity surface being reduced to provide a reduced surface area of contact therebetween.

20. The hydraulic pressure device of claim 19 characterized in that said reduced surface area of contact is a ring.

21. The hydraulic pressure device of claim 20 characterized in that said ring is substantially centered on the overlap between said plate surface and said cavity surface.

22. The gerotor hydraulic pressure device of claim 13 wherein the rotor has a second surface parallel to the surface and characterized by the addition of a second cavity, said second cavity being in the housing adjacent to the second surface of the rotor, said second cavity having a depth, a second plate, said second plate being compressible, said second plate having an axial length, said axial length of said second plate being greater than said depth of said second cavity, said second plate being in said second cavity, the stator partially closing one wide of said second cavity, and means to seat the stator being to the housing to compress said axial length of said second plate to said depth of said second cavity.

23. The gerotor hydraulic pressure device of claim 22 characterized in that said second plate is a manifold.

24. The gerotor hydraulic pressure device of claim 22 wherein the housing is held together by bolts and characterized in that tightening the bolts fully compresses said plate and said second plate.

25. The gerotor hydraulic pressure device of claim 22 wherein the housing, stator, said plate and said second plate each have modulus of elasticity and characterized in that the modulus of said plate and said second plate is lower than either the modulus of the housing or stator.

26. The gerotor hydraulic pressure device of claim 22 wherein said plate and said second plate have a compressive stress/strain curve and characterized in that said plate and said second plate are compressed within the limits of such curve.

27. The hydraulic pressure device of claim 22 characterized in that said second cavity has a second cavity surface substantially parallel to the second surface of the rotor, said second plate having a second plate surface, said second plate surface overlapping said second cavity surface, and at least one of said second plate surface or said second cavity surface being reduced to provide a reduced surface area of contact therebetween.

28. The hydraulic pressure device of claim 27 characterized in that said reduced surface area of contact is a ring.

29. The hydraulic pressure device of claim 28 characterized in that said ring is substantially centered on the overlap between said second plate surface and said second cavity surface.

30. The hydraulic pressure device of claim 13 characterized in that said plate having an outside, an inside cavity, and means in said plate to connect said outside to said inside cavity.

31. The hydraulic pressure device of claim 30 characterized by the addition of a case drain and means in the housing to connect said outside to said case drain.

32. The hydraulic pressure device of claim 31 characterized by the addition of a case drain and means in the housing to connect said inside cavity to said case drain.

33. The hydraulic pressure device of claim 13 characterized by an area, said area being located in said cavity outside of said plate, said plate having an inside cavity, a hole, and said hole being in said plate fluidically connecting said area to said inside cavity of said plate.

34. The hydraulic pressure device of claim 33 characterized by the addition of a case drain, said case drain being in said housing substantially outwards of said cavity, and said case drain connected first to said area and then said hole.

35. The hydraulic pressure device of claim 33 characterized by the addition of a case drain, said case drain being in said housing, and said case drain connected first to said inside cavity in said plate and then said hole.

* * * * *